US008736153B2

(12) United States Patent
Nezu

(10) Patent No.: US 8,736,153 B2
(45) Date of Patent: May 27, 2014

(54) LAMP APPARATUS AND LUMINAIRE

(75) Inventor: Kenji Nezu, Yokosuka (JP)

(73) Assignee: Toshiba Lighting & Technology Corporation, Yokosuka-shi, Kanagawa (JP)

( * ) Notice: Subject to any disclaimer, the term of this patent is extended or adjusted under 35 U.S.C. 154(b) by 0 days.

(21) Appl. No.: 13/618,719

(22) Filed: Sep. 14, 2012

(65) Prior Publication Data

US 2013/0214665 A1 Aug. 22, 2013

(30) Foreign Application Priority Data

Feb. 22, 2012 (JP) ..... 2012-036107

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.

USPC ..... 313/46; 165/DIG. 346; 165/DIG. 416; 165/DIG. 498; 165/DIG. 516; 362/547; 362/218; 362/264; 362/294; 362/373

(58) Field of Classification Search

USPC ..... 313/46; 362/547, 218, 264, 294, 373; 165/151, DIG. 201, DIG. 328, DIG. 329, 165/DIG. 346, DIG. 405, DIG. 409, 165/DIG. 416, DIG. 444, DIG. 498, DIG. 516

See application file for complete search history.

(56) References Cited

U.S. PATENT DOCUMENTS

| | | | | |
|---|---|---|---|---|
| 8,253,310 | B1 * | 8/2012 | Xia | 313/46 |
| 2003/0003287 | A1 * | 1/2003 | Tobita | 428/297.4 |
| 2006/0181878 | A1 * | 8/2006 | Burkholder | 362/294 |
| 2010/0289396 | A1 * | 11/2010 | Osawa et al. | 313/46 |
| 2011/0050070 | A1 * | 3/2011 | Pickard | 313/46 |
| 2011/0089830 | A1 * | 4/2011 | Pickard et al. | 315/32 |
| 2011/0204763 | A1 * | 8/2011 | Shum et al. | 313/46 |
| 2011/0204780 | A1 * | 8/2011 | Shum et al. | 315/35 |

FOREIGN PATENT DOCUMENTS

| | | | |
|---|---|---|---|
| CN | 201748262 | U | 2/2011 |
| EP | 2149742 | A2 | 2/2010 |
| EP | 2163808 | A1 | 3/2010 |
| EP | 2180249 | A1 | 4/2010 |
| EP | 2320133 | A2 | 5/2011 |
| JP | 2011-113861 | | 6/2011 |
| JP | 2011-175932 | | 9/2011 |
| JP | 2011-187296 | A | 9/2011 |
| WO | 2012020830 | A1 | 2/2012 |

OTHER PUBLICATIONS

Extended EP Search Report dtd Jan. 14, 2013, EP Appln. 12184168.8.

* cited by examiner

*Primary Examiner* — Nimeshkumar Patel
*Assistant Examiner* — Jose M Diaz
(74) *Attorney, Agent, or Firm* — Banner & Witcoff, Ltd.

(57) ABSTRACT

A lamp apparatus includes an apparatus body including a housing having a cap at one end side, and thermal conducting fins provided on an inner surface of the housing so as to extend from the one end side along the other end side thereof and project inward of the housing, a thermal radiation plate attached to the other end side of the housing in a state in which one surface side is in contact with the thermal conducting fins, a light-emitting body attached to the other surface side of the thermal radiation plate, and a lighting circuit disposed in the housing and configured to light the light-emitting body.

4 Claims, 10 Drawing Sheets

LAMP APPARATUS AND LUMINAIRE

CROSS-REFERENCE TO RELATED APPLICATION

This application is based upon and claims priority from prior Japanese Patent Application No. 2012-036107, filed on Feb. 22, 2012, the entire contents of which are incorporated herein by reference.

FIELD

Exemplary embodiments described herein relate generally to a lamp apparatus having a cap and a luminaire in which the lamp apparatus is mounted.

BACKGROUND

In the related art, for example, an LED bulb (lamp apparatus) having a cap which is mountable in a socket for general lighting bulbs is provided with a resin or metallic housing having a cap mounting portion to which the cap is fixed on one end side thereof. Then, the LED bulb includes alighting apparatus accommodated in the interior of the housing and an LED module (light-emitting body) mounted on the other end side of the housing. Provided on an outer peripheral surface of the housing are thermal radiating fins for radiating heat generated by the LED module or the lighting apparatus. A globe configured to cover the LED module as needed is attached to the other end side of the housing.

The LED module generates heat in association with lighting of LEDs. The heat rises the temperature of the LEDs. Then, when the temperature of the LEDs is excessively high, light-emitting efficiency of the LEDs is lowered, and a problem such as reduction of lifespan of the LEDs may occur. Therefore, the housing is provided with a thermal radiating device configured to radiate heat generated by the LED module from the thermal radiating fins to an outside space.

Examples of the LED bulb include the one configured in such a manner that an outer peripheral edge portion side of the LED module is fixed to an annular mounting surface of the housing, and the lighting apparatus is accommodated in a void of the housing (for example, see Patent Document 1). According to the LED bulb described above, the heat generated by the LED module is conducted from the annular mounting surface to the housing and radiated to the outside space from the thermal radiating fins.

There is also an LED bulb of a type in which the LED module is placed on a flat-shaped light source supporting portion of the housing and is disposed in tight contact therewith so as to allow thermal conduction (for example, see Patent Document 2). According to the LED bulb described above, the heat generated by the LED module is transferred to the light source supporting portion which is in tight-contact with the LED module and is radiated effectively from the housing to the outside space via the thermal radiating fins.

The configuration in which the outer peripheral edge portion side of the LED module is fixed to the annular mounting surface of the housing allows the heat generated by the LED module to be conducted mainly from the outer peripheral edge portion side of the LED module to the mounting surface of the housing. Therefore, the heat can hardly be conducted quickly to the housing side. Therefore, the above-described configuration is disadvantageous in that inhibition of temperature rise of the LEDs with respect to a high-power and high-output LED module is difficult.

The configuration in which the LED module is placed on the flat-shaped light source supporting portion of the housing and is brought into tight contact therewith allows the heat generated by the LED module to be conducted quickly to the housing and to be radiated from the thermal radiating fins because the contact surface area between the LED module and the light source supporting portion is large. However, since the portion of the light source supporting portion is formed on a mass of the housing, the configuration in this example is disadvantageous in that a space for disposing the lighting apparatus can hardly be secured and the weight of the housing is increased. In particular, when the housing is formed of a metal, the weight may pose a problem.

DETAILED DESCRIPTION

Figure 1:
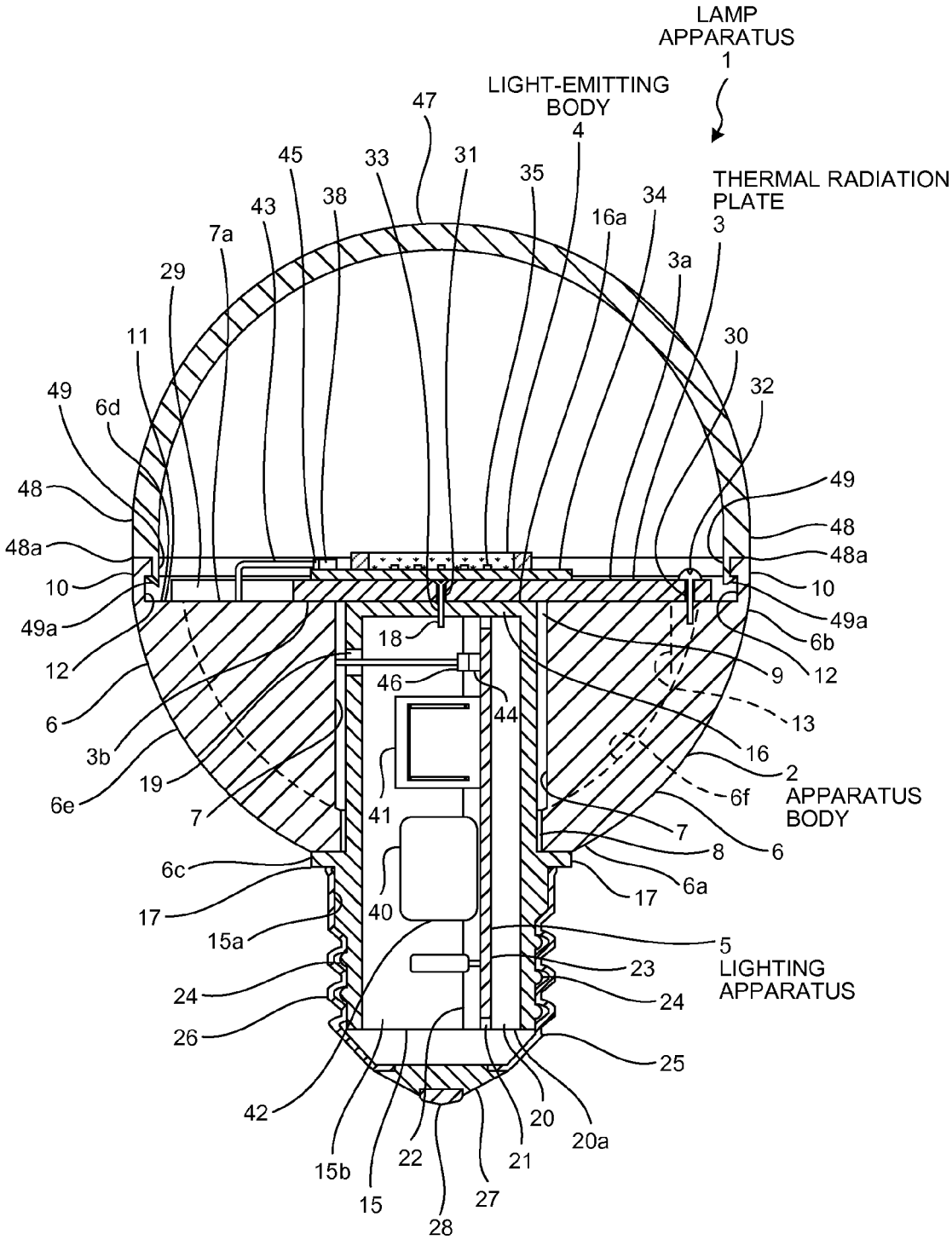
FIG. 1 is a schematic front cross-sectional view of a lamp apparatus according to a first exemplary embodiment.

A lamp apparatus 1 according to an exemplary embodiment includes an apparatus body 2, a thermal radiation plate 3, a light-emitting body 4, and a lighting apparatus (lighting circuit) 5. The apparatus body 2 includes a housing 6 having a cap 25 at one end side 6*a*, and at least one thermal conducting fin 7 provided on an inner surface 6*f* of the housing 6 so as to extend from the one end side 6*a* along the other end side 6*b* thereof and project inward of the housing 6. The thermal radiation plate 3 is attached to the other end side 6*b* of the housing 6 in a state in which one surface side 3*b* is in contact with the thermal conducting fins 7. The light-emitting body 4 is attached to the other surface side 3*a* of the thermal radiation plate 3. The lighting apparatus 5 is disposed in the housing 6 and lights the light-emitting body 4.

Hereinafter, referring to the drawings, an exemplary embodiment of the lamp apparatus and a luminaire will be described. First of all, the lamp apparatus and the luminaire according to a first exemplary embodiment will be described.

The lamp apparatus 1 according to the first exemplary embodiment is configured as illustrated in FIG. 1 to FIG. 4. In FIG. 1, the lamp apparatus 1 includes the apparatus body 2, the thermal radiation plate 3, the light-emitting body 4, and the lighting apparatus 5.

The apparatus body 2 includes the housing 6 and the thermal conducting fins 7. The apparatus body 2 in this configuration is formed of a metallic material having a high thermal conductivity such as aluminum (Al) for example. The apparatus body 2 is formed integrally with the housing 6 and the thermal conducting fins 7 by, for example, casting (aluminum die-casting).

The housing 6 is formed with an opening 8 on the one end side 6*a* and an opening 9 on the other end side 6*b*. The housing 6 is formed into a substantially cup-shaped cylindrical shape widening from the one end side 6*a* toward the other end side 6*b*. The housing 6 has a predetermined thickness (for example, 1.5 to 5 mm), an outer surface 6*e* and the inner surface 6*f* are formed into curved surfaces, respectively. The housing 6 is formed with an annular wall 10 on an end surface 6*d* of the other end side 6*b*. The end surface 6*d* inside the annular wall 10 is an annular flat mounting surface 11. The thermal radiation plate 3 is placed on the mounting surface 11. An annular groove 12 is formed from the mounting surface 11 toward the annular wall 10.

Figure 4:
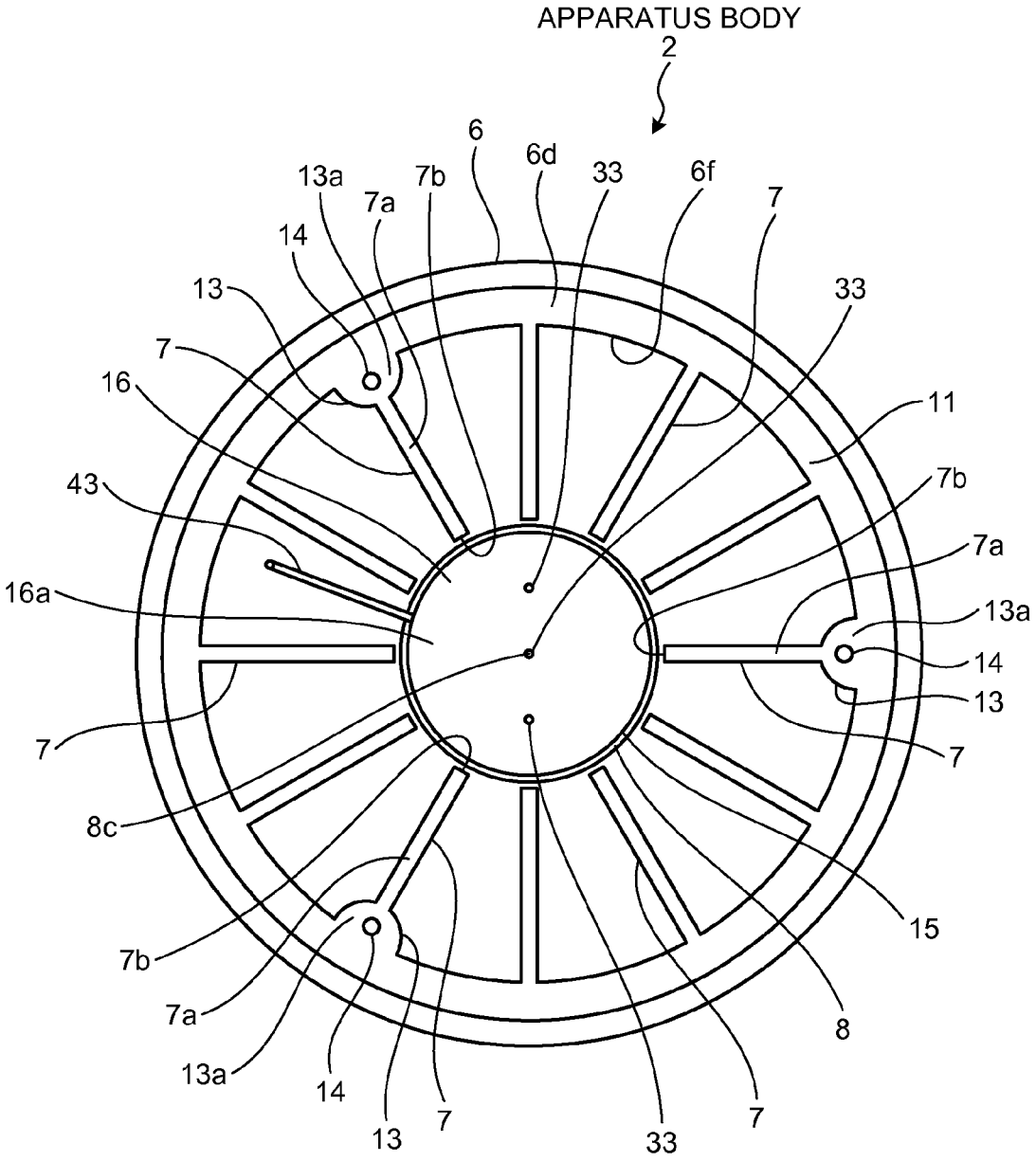
FIG. 4 is a schematic top view of the apparatus body.

The housing 6 is formed with dwells 13 on the inner surface 6*f* on the other end side 6*b* thereof as illustrated in FIG. 4. The dwells 13 each have an upper surface 13*a* flush with the mounting surface 11 (end surface 6*d*). The dwells 13 are formed into a substantially dome shape (semi-column shape) pending at a right angle with respect to the mounting surface 11 in FIG. 4. The upper surface 13*a* of each of the dwells 13 is formed with a screw hole 14 for mounting the thermal radiation plate 3. Three of the dwells 13 are provided at intervals of 120° in the circumferential direction of the inner surface 6*f* of the housing 6 with respect to a center 8*c* of the opening 8 of the housing 6.

The thermal conducting fins 7 are formed into a plate shape, and a plurality of the fins are provided on the inner surface 6*f* of the housing 6. The thickness of the thermal conducting fins 7 is, for example, 1 to 5 mm. Then, the thermal conducting fins 7 are provided so as to extend from the one end side 6*a* to the other end side 6*b* of the housing 6, and so as to project from the inner surface 6*f* inward of the housing 6. Here, the thermal conducting fins 7 are provided on the inner surface 6*f* of the housing 6 from the mounting surface 11 (end surface 6*d*) to the vicinity of the opening 8. Upper side end surfaces (upper surfaces) 7*a* of the thermal conducting fins 7 are flush with the mounting surface 11 (end surface 6*d*). Distal end side end surfaces (side end surfaces) 7*b* as distal ends of the thermal conducting fins 7 are provided so as to extend upright from the one end side 6*a* to the other end side 6*b* of the housing 6.

The plurality of thermal conducting fins 7 are provided at regular intervals (at intervals of 30° here) in the direction of an inner circumference of the inner surface 6*f* of the housing 6, and are provided radially with respect to the center 8*c* of the opening 8. A mounting body 15 is disposed in a space of the housing 6 surrounded by the distal end side end surfaces (side end surfaces) 7*b* of the thermal conducting fins 7.

The thickness, the number of the thermal conducting fins 7, and the distance between the thermal conducting fins 7 and 7 are not specifically limited. For example, the distance is not limited to the above-described 30°, the minimum intervals between the thermal conducting fins 7 and 7 are set to a range from 3 to 10 mm considering improvement of manufacturability of the apparatus body 2, improvement of thermal conductivity to the housing 6, and reduction of confine of heat in the housing 6.

The mounting body 15 is formed into a bottomed substantially circular cylindrical shape as illustrated in FIG. 1, and is inserted from the opening 8 of the housing 6 into the housing 6. The mounting body 15 is formed of, for example, polybutylene terephthalate (PBT) resin, and has electric insulating properties.

The mounting body 15 is formed with an annular seat 17 coming into abutment with an end surface 6*c* of the housing 6 on the opening 8 side so that an upper surface 16*a* of a bottom portion 16 thereof is flush with the upper side end surfaces 7*a* of the thermal conducting fins 7. The mounting body 15 is attached to the thermal radiation plate 3 with flat-head screws 18 with the annular seat 17 in abutment with the end surface 6*c* of the housing 6.

The mounting body 15 is formed with an insertion hole 19 on an inner wall 15*b* of the mounting body 15 on the side of the bottom portion 16. A pair of depressions 21 are formed on the inner wall 15*b* linearly from the bottom portion 16 to an end surface 20*a* of an opening 20 on the side opposite from the bottom portion 16 so as to face each other and a pair of guide projecting portions 22 adjacent to the depressions 21 are formed so as to face each other. The depressions 21 are formed to have a width to allow press fitting of both end portions of a substrate 23 in the width direction of the lighting apparatus 5, and are formed to be shallow with respect to a thin mounting body 15. The guide projecting portions 22 are configured to guide the substrate 23 along the longitudinal direction.

The mounting body 15 is formed with a projecting ridge 24 in a spiral pattern on an outer surface 15*a* of the mounting body 15 on the side of the opening 20 with respect to the annular seat 17. The cap 25 is screwed onto the projecting ridge 24. The cap 25 is calked and fixed to the outer surface 15*a* of the mounting body 15.

The cap 25 is connectable to a socket of an E26 type general light bulb, and includes a cap shell portion 26 to be screwed, caulked, and fixed to the projecting ridge 24, an insulating portion 27 provided on the other end side of the cap shell portion 26, and a cap eyelet portion 28 provided at a top portion of the insulating portion 27. The cap 25 and the housing 6 are electrically insulated by the annular seat 17 of the mounting body 15. In this manner, the housing 6 has the cap 25 on the one end side 6*a* of the housing 6 via the mounting body 15.

The thermal radiation plate 3 is formed of a metallic material having a high thermal conductivity such as aluminum (Al), for example. The thermal radiation plate 3 is formed into a disk shape having a notched portion 29 on the outer peripheral side thereof. The thickness of the thermal radiation plate 3 is 2 to 8 mm and, for example, 4 mm. The thermal radiation plate 3 is formed with through holes 30 corresponding to the screw holes 14 of the dwells 13 of the housing 6 on the outer peripheral side thereof. The thermal radiation plate 3 is formed with insertion holes 31 to allow insertion of the flat-head screws 18 at the center thereof.

Figure 3:
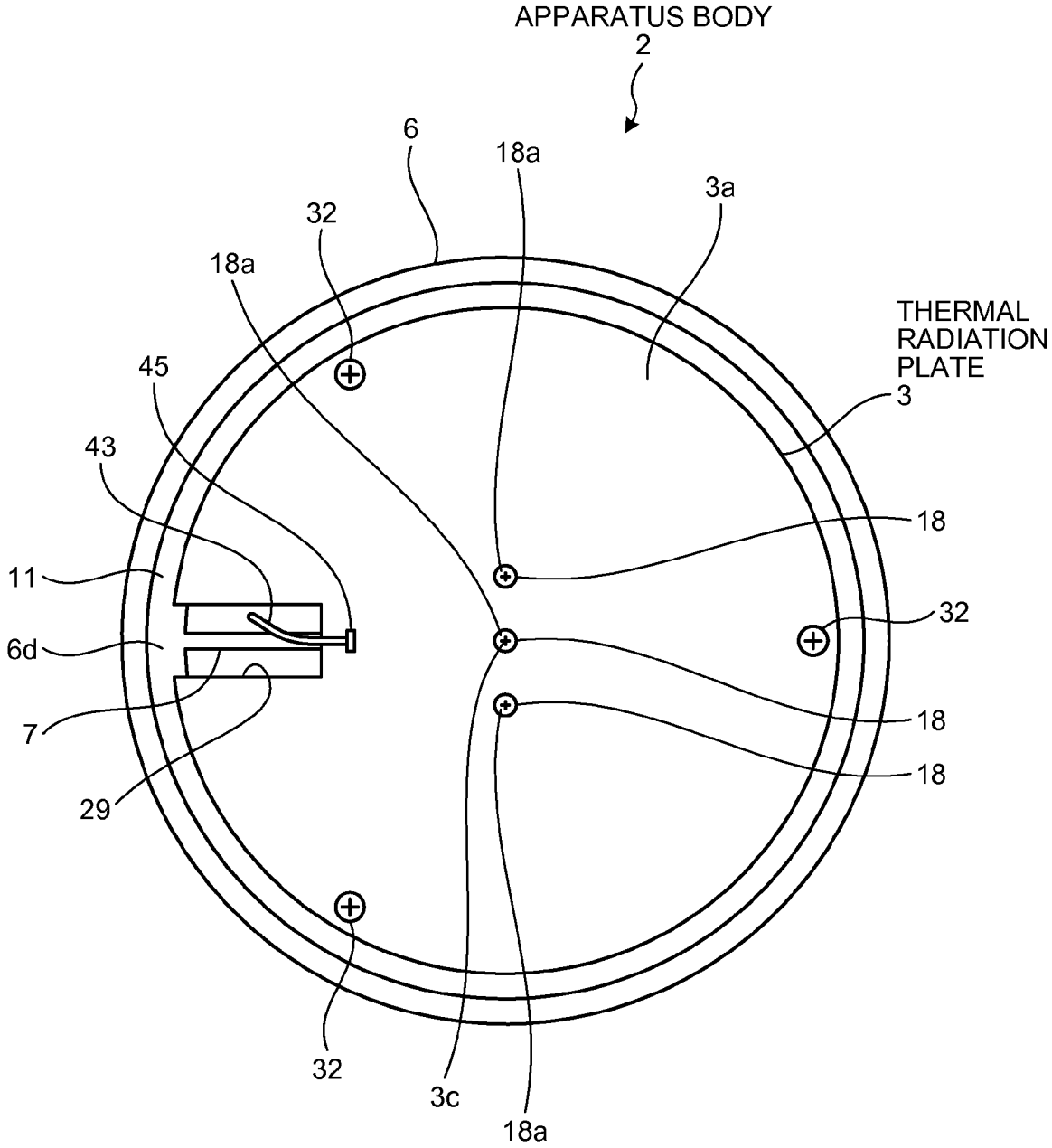
FIG. 3 is a schematic top view of an apparatus body in a state in which a thermal radiation plate is mounted.

The outer peripheral side of the one surface side 3*b* of the thermal radiation plate 3 is placed on the mounting surface 11 of the housing 6. At this time, the one surface side 3*b* of the thermal radiation plate 3 comes into contact with the upper side end surfaces 7*a* of the thermal conducting fins 7. The opening 9 of the housing 6 is closed by the thermal radiation plate 3 except for the notched portion 29 of the thermal radiation plate 3. Then, the through holes 30 of the thermal radiation plate 3 and the screw holes 14 of the housing 6 are aligned (faced each other), then screws 32 are completely screwed from the through holes 30 into the screw holes 14. Accordingly, the thermal radiation plate 3 is attached to the other end side 6*b* of the housing 6. In other words, as illustrated in FIG. 3, the thermal radiation plate 3 is fixed to the mounting surface 11 (end surface 6*d*) of the housing 6 with three of the screws 32 screwed at intervals of 120° with respect to a center 3*c* of the thermal radiation plate 3.

After the thermal radiation plate 3 is mounted on the housing 6, the mounting body 15 is mounted on the thermal radiation plate 3. The mounting body 15 is formed with screw holes 33 on the bottom portion 16 as illustrated in FIG. 4. The screw holes 33 communicate with the interior of the mounting body 15 from the upper surface 16*a* of the bottom portion 16. Here, three of the screw holes 33 are formed linearly on the upper surface 16*a* of the bottom portion 16.

The thermal radiation plate 3 is formed with three of the insertion holes 31 corresponding to the screw holes 33 of the mounting body 15 on the center side of the thermal radiation plate 3. As illustrated in FIG. 1, the screw holes 33 of the mounting body 15 inserted from the opening 8 of the housing 6 are aligned with the insertion holes 31, and then the flat-head screws 18 are inserted from the other surface side (upper surface side) 3*a* of the thermal radiation plate 3 and are completely screwed into the screw holes 33 of the mounting body 15. The thermal radiation plate 3 fixes the mounting body 15 by three of the flat-head screws 18 as illustrated in FIG. 3. At this time, head portions 18*a* of the flat-head screws 18 do not project from the other surface side 3*a* of the thermal radiation plate 3. In other words, the insertion holes 31 of the thermal radiation plate 3 are formed so that the head portions 18*a* of the flat-head screws 18 are embedded.

Figure 2:
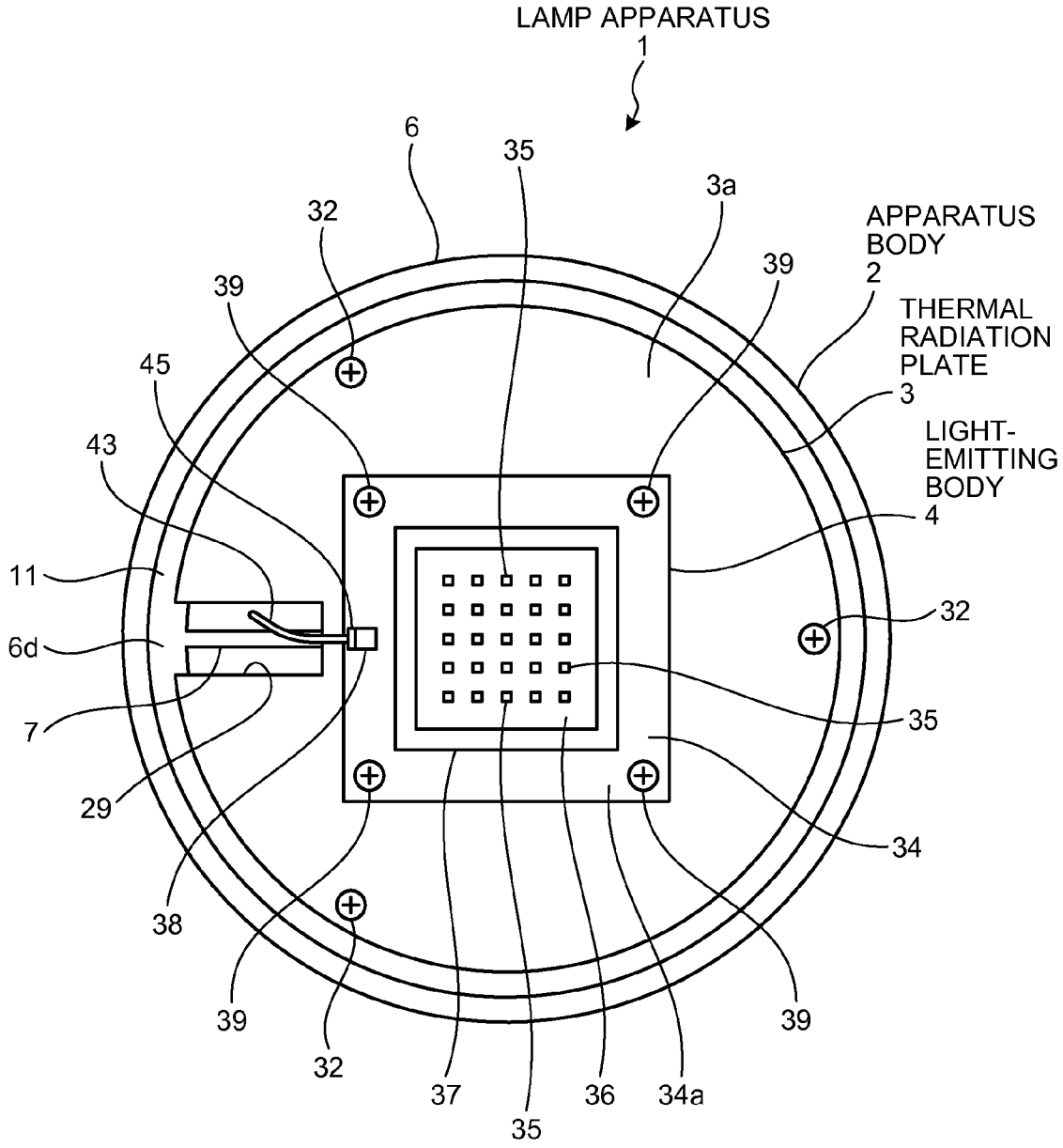
FIG. 2 is a schematic top view in a state in which a globe is removed.

In FIG. 2, the light-emitting body 4 has a substrate 34 and a plurality of LED bear chips 35 and a sealing resin 36. The substrate 34 is formed of an aluminum (Al) plate having a thickness of 1.2 mm, for example, and is formed to have a square-shaped outline. The LED bear chips 35 are formed to emit blue light, for example, and are mounted on the substrate 34 by COB (Chip On Board) system. In other words, the light-emitting body 4 is composed of the plurality of LED bear chips 35 mounted on one surface 34*a* side of the substrate 34 in a matrix pattern via an insulating layer having a high thermal conductivity, not illustrated. The light-emitting body 4 is provided with a frame portion 37 configured to surround the LED bear chips 35. The frame portion 37 is formed of, for example, silicone resin. The interior of the frame portion 37 is filled with the sealing resin 36 such as silicone resin, for example, for covering and sealing the LED bear chips 35. The sealing resin 36 is mixed with yellow phosphor, not illustrated, that radiates yellow light by being excited by part of the blue light from the LED bear chips 35.

A female connector 38 is mounted on the one surface 34*a* side of the substrate 34. The female connector 38 is electrically connected to the LED bear chips 35 by a wiring pattern, not illustrated. The plurality of LED bear chips 35 are connected in series from one row to another, for example. The light-emitting body 4 has a light-emitting surface on the surface of the sealing resin 36, and radiates white light mixed with the blue light and the yellow light from the light emitting surface.

The light-emitting body 4 is attached to the other surface side 3*a* of the thermal radiation plate 3. In other words, mounting holes, not illustrated, to allow screws 39 to pass through are formed at four corners of the substrate 34. Four of the screws 39 pass through the mounting holes and screwed into screw holes, not illustrated, provided on the thermal radiation plate 3. Accordingly, the light-emitting body 4 is attached to the center of the other surface side 3*a* of the thermal radiation plate 3.

For reference, the substrate 34 may be formed of resin material such as glass epoxy material or paper phenol material, and may be formed of a ceramic plate having by itself insulating properties.

In FIG. 1, the lighting apparatus 5 is configured to light the LED bear chips 35 of the light-emitting body 4, and is accommodated in the interior of the mounting body 15. In other words, the lighting apparatus 5 is disposed in the housing 6.

The lighting apparatus 5 is formed to have the substrate 23 and a circuit component 42 such as an electronic component 40 and a transformer 41 mounted on the substrate 23. The substrate 23 is formed of a synthetic resin plate such as glass epoxy material or a metallic plate such as aluminum (AI), and is formed into a rectangular shape. In the case of the metallic plate, an insulating layer is formed and the circuit component 42 is mounted thereon. The substrate 23 is inserted so as to be press-fitted into the pair of depressions 21 and 21 of the mounting body 15, and is mounted inside the mounting body 15.

The input side of the lighting apparatus 5 is connected to the cap shell portion 26 and the cap eyelet portion 28 of the cap 25 by a lead wire, not illustrated, and the output side of the lighting apparatus 5 is connected to the substrate 34 of the light-emitting body 4 by an electrical supply line 43. The substrate 34 of the light-emitting body 4 is provided with the female connector 38, and the substrate 23 of the lighting apparatus 5 is provided with a female connector 44. Provided at both ends of the electrical supply line 43 are male connectors 45 and 46, respectively.

The male connector 46 of the electrical supply line 43 is mounted on the female connector 44 of the lighting apparatus 5. Then, the electrical supply line 43 is inserted through the insertion hole 19 of the mounting body 15, between the thermal conducting fins 7 and 7 of the apparatus body 2 and the notched portion 29 of the thermal radiation plate 3, and the male connector 45 is mounted on the female connector 38 of the light-emitting body 4. The male connector 46 is mounted on the female connector 44 before the lighting apparatus 5 is mounted on the mounting body 15. Then, the electrical supply line 43 and the male connector 45 are inserted into the insertion hole 19 of the mounting body 15, between the thermal conducting fins 7 and 7 of the apparatus body 2, and the notched portion 29 of the thermal radiation plate 3 before the mounting body 15 is mounted on the thermal radiation plate 3. In this manner, the lighting apparatus 5 is connected to the cap 25 and the LED bear chips 35 of the light-emitting body 4. The lighting apparatus 5 is operated by receiving a supply of power via the cap 25, supplies a predetermined constant current to the LED bear chips 35 and causes the LED bear chips 35 to light (emit light).

Then, a globe 47 is attached to the other end side 6*b* of the housing 6 so as to cover the light-emitting body 4. The globe 47 is formed to have an outline of, for example, a substantially semi-spherical shape of a transparent resin material such as polycarbonate (PC) resin. An opening end portion 48 of the globe 47 has the same outer diameter as the annular wall 10 of the housing 6. Locking claws 49*a* of locking strips 49 extending from an opening end surface 48*a* lock the annular wall 10 in the annular groove 12 of the housing 6 so that the end surface 48*a* of the opening end portion 48 comes into tight contact with the end surface (upper surface)of the annular wall 10. A plurality of, for example, four of the locking strips 49 are provided at regular intervals along the circumferential direction of the annular groove 12.

Subsequently, operations of the first exemplary embodiment will be described.

The cap 25 of the lamp apparatus 1 is screwed into a bulb socket. When the cap 25 receives a supply of power via the bulb socket, the lighting apparatus 5 is operated. The lighting apparatus 5 supplies a predetermined constant current to the LED bear chips 35 of the light-emitting body 4 via the electrical supply line 43. The LED bear chips 35 light (emit light), and generate heat. Then, white light is radiated from the light-emitting body 4.

The white light radiated from the light-emitting body 4 passes through the globe 47 covering the light-emitting body 4, and goes out to the outside space. Accordingly, a lighting area of the lamp apparatus 1 is lit by the white light.

The heat generated in association with lighting of the LED bear chips 35 is transferred to the substrate 34 of the light-emitting body 4, and is transferred to the thermal radiation plate 3 from the substrate 34. The thermal radiation plate 3 is formed of a metallic material having a high thermal conductivity such as aluminum (Al), for example, and hence the heat transferred to the thermal radiation plate 3 is conducted to the entire area of the thermal radiation plate 3 quickly. The thermal radiation plate 3 is subjected to a temperature rise due to the heat transferred from the substrate 34, and is capable of transferring the heat to the apparatus body 2.

The thermal radiation plate 3 is placed on the annular mounting surface 11 (end surface 6*d*) of the housing 6, and hence the heat of the thermal radiation plate 3 is conducted from the mounting surface 11 to the housing 6. Since the mounting surface 11 is provided in the annular shape, the heat of the thermal radiation plate 3 is conducted from the entire outer peripheral side of the thermal radiation plate 3 to the housing 6.

Since the thermal radiation plate 3 is in contact with the upper side end surfaces (upper surfaces) 7*a* of the thermal conducting fins 7, the heat of the thermal radiation plate 3 is conducted to the thermal conducting fins 7. Since the thermal conducting fins 7 are provided on the inner surface 6*f* of the housing 6 extending from the mounting surface 11 (end surface 6*d*) to a portion near the opening 8, the upper side end surfaces (upper surfaces) 7*a* of the thermal conducting fins 7 are in contact with a portion from the outer peripheral side to the center side of the thermal radiation plate 3 where the light-emitting body 4 is attached. Therefore, a contact surface area between the thermal conducting fins 7 and the thermal radiation plate 3 is large correspondingly, and heat of the thermal radiation plate 3 from the center side to the outer peripheral side is conducted to the thermal conducting fins 7. In other words, a corresponding quantity of heat is conducted from the thermal radiation plate 3 to the thermal conducting fins 7, and the heat transferred from the light-emitting body 4 to the thermal radiation plate 3 is liable to be quickly conducted to the thermal conducting fins 7.

The thermal conducting fins 7, being composed of a plurality of fins, are provided radially with respect to the center 8*c* of the opening 8 of the housing 6 at regular intervals in the direction of the inner circumference of the inner surface 6*f* of the housing 6, and hence the upper side end surfaces (upper surfaces) 7*a* of the thermal conducting fins 7 are in contact with the thermal radiation plate 3 at regular intervals in the direction of outer circumference of the thermal radiation plate 3 and radially with respect to the center 3*c* of the thermal radiation plate 3. Therefore, the heat of the entire area of the thermal radiation plate 3 is conducted to the plurality of thermal conducting fins 7 substantially equally.

In this manner, the heat transferred from the light-emitting body 4 to the thermal radiation plate 3 is conducted from the thermal radiation plate 3 to the mounting surface 11 of the housing 6 and the plurality of thermal conducting fins 7 substantially equally. The heat conducted to the thermal conducting fins 7 is conducted to the housing 6 integrated with the thermal conducting fins 7. The heat conducted from the mounting surface 11 and the thermal conducting fins 7 respectively to the housing 6 is discharged from the entire area of the outer surface 6*e* of the housing 6 to the outside space.

The heat generated in the light-emitting body 4 in this manner is radiated quickly to the outside space from the outer surface 6*e* of the housing 6. Accordingly, the LED bear chips 35 of the light-emitting body 4 are maintained to be lit at temperature not exceeding an allowable temperature, and hence problems such as lowering of the light-emitting efficiency or short lifespan are prevented. By the quick radiation of the heat generated in the light-emitting body 4, high-power LED bear chips 35 may be used, or the number of the LED bear chips 35 to be mounted on the substrate 34 may be increased. Accordingly, high-output light radiation from the light-emitting body 4 is enabled.

When the lighting apparatus 5 is operated, the circuit component 42 generates heat. In particular, the quantity of heat generation from heat radiating components such as the transformer 41 is significant. The heat generated in the lighting apparatus 5 is transferred to the mounting body 15. Then, the heat is mainly transferred from the mounting body 15 to the cap 25, and is radiated from the bulb socket to which the cap 25 is secured by screwing.

The lamp apparatus 1 has a structure in which the plurality of thermal conducting fins 7 come into contact with the thermal radiation plate 3, and the spaces are formed between the thermal conducting fins 7 and 7. Therefore, the sum of volumes of the plurality of thermal conducting fins 7 is not large, and hence the weight does not increase, whereby a light-weight apparatus body 2 is achieved. In other words, the housing 6 is not provided with a mass which comes into contact with the thermal radiation plate 3, and hence the light-weight is achieved.

Since the plurality of thermal conducting fins 7 are formed to allow the mounting body 15 which accommodates the lighting apparatus 5 to be disposed within a space surrounded by the distal end side end surfaces (side end surfaces) 7*b* of the thermal conducting fins 7, so that a space for disposing the lighting apparatus 5 is secured in the housing 6. In this manner, the apparatus body 2 ensures the light-weight of the housing 6 and provision of the space for disposing the lighting apparatus 5.

According to the lamp apparatus 1 in the exemplary embodiment, since the thermal radiation plate 3 having the light-emitting body 4 mounted thereon is attached to the other end side 6*b* of the housing 6 in contact with the thermal conducting fins 7, the heat generated in the light-emitting body 4 can be conducted quickly from the thermal conducting fins 7 to the housing 6, and be radiated from the outer surface 6*e* of the housing 6 to the outside space, whereby the lamp apparatus 1 has advantages such that the high-power and high-output of the LED bear chips 35 may be achieved.

The plurality of thermal conducting fins 7 are provided at regular intervals and radially in the direction of the inner circumference of the inner surface 6*f* of the housing 6, the lighting apparatus 5 is accommodated in the mounting body 15 and is disposed within the space surrounded by the distal end side end surfaces (side end surfaces) 7*b* as the distal ends of the thermal conducting fins 7. Therefore, advantages such that the light-weight of the housing 6 is achieved and the heat generated by the light-emitting body 4 can be conducted from the entire area of the thermal radiation plate 3 to the thermal conducting fins 7 in a state in which the space for disposing the lighting apparatus 5 is secured, thereby enabling the thermal radiation from the entire outer surface 6*e* of the housing 6 are achieved.

Subsequently, a lamp apparatus and a luminaire according to a second exemplary embodiment will be described.

Figure 5:
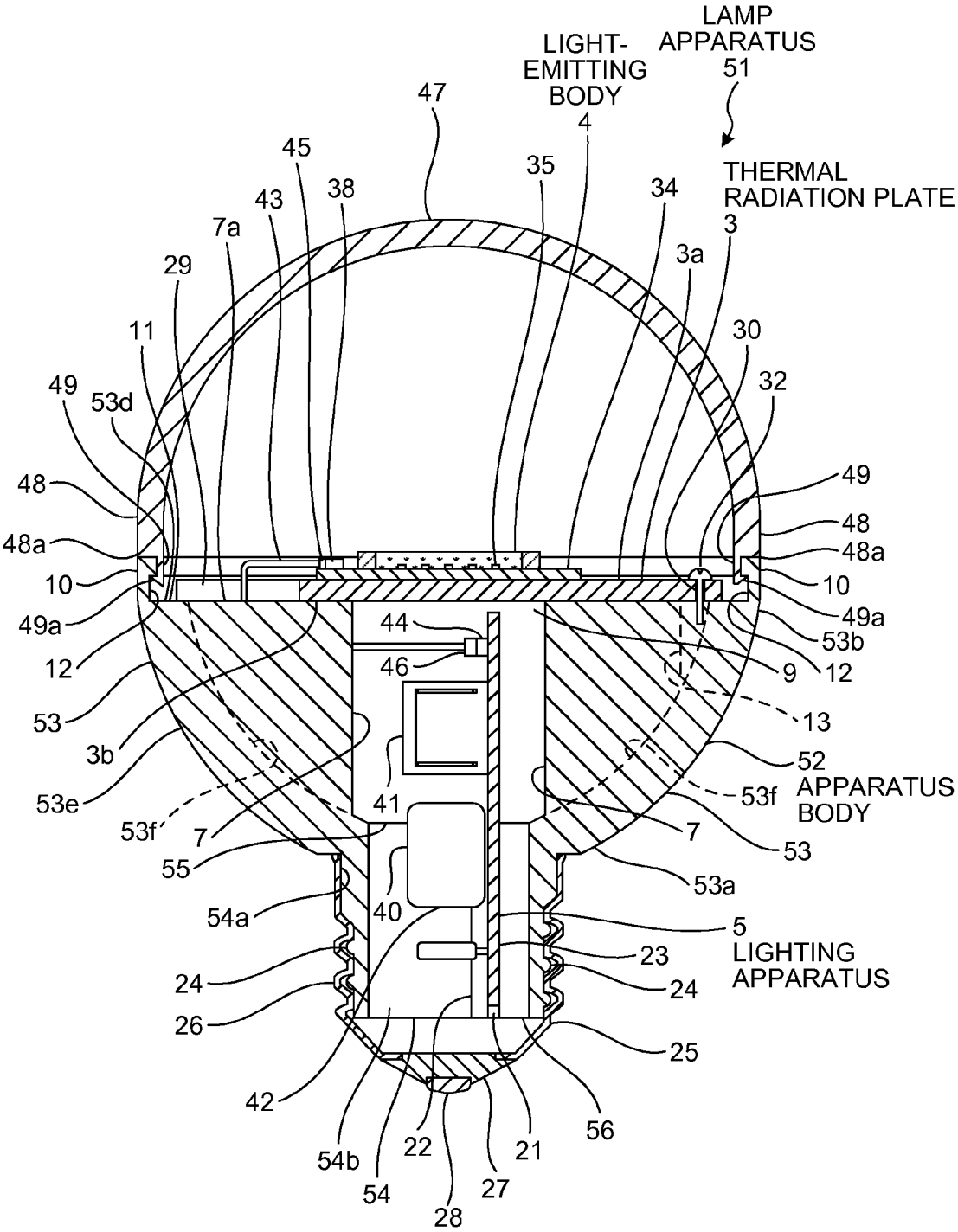
FIG. 5 is a schematic front cross-sectional view of a lamp apparatus according to a second exemplary embodiment.
Figure 6:
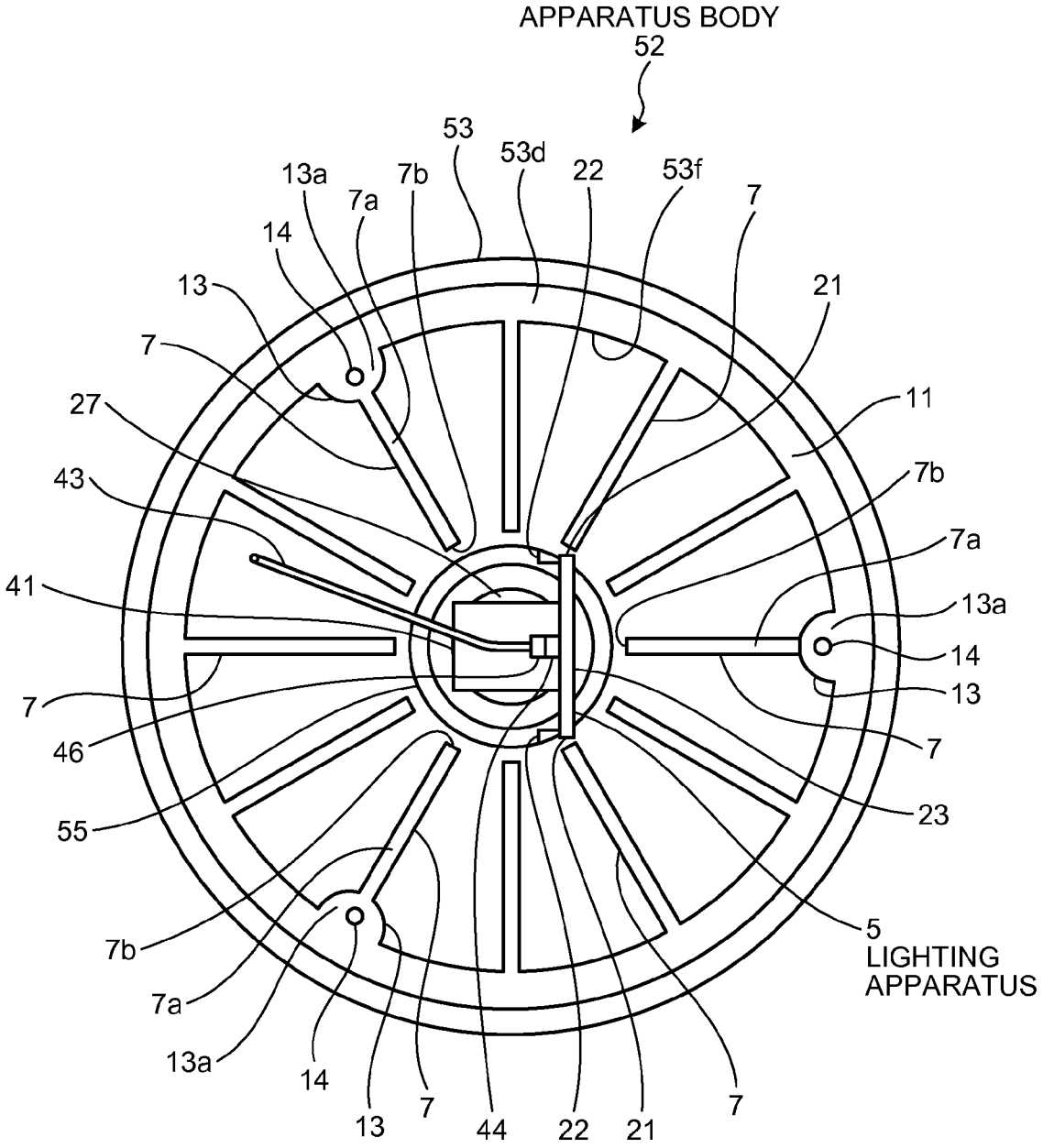
FIG. 6 is a schematic top view of an apparatus body.

A lamp apparatus 51 in this exemplary embodiment is configured as illustrated in FIG. 5 and FIG. 6. The same parts and parts corresponding to the same parts in FIG. 5 and FIG. 6 as those in FIG. 1 and FIG. 4 are designated by the same reference numerals and the description will be omitted.

In FIG. 5, the lamp apparatus 51 is configured to be the same as the lamp apparatus 1 illustrated in FIG. 1 except that the configuration of an apparatus body 52 is different, and the thermal radiation plate 3 is not formed with the insertion holes 31.

The apparatus body 52 has a housing 53 and the thermal conducting fins 7, and is formed of a synthetic resin having high-thermal conductivity, high thermal resistant properties, and electrical insulating properties such as, for example, polybutylene terephthalate (PBT) resin. The apparatus body 52 is formed integrally with the housing 53 and the thermal conducting fins 7 by, for example, injection molding.

The housing 53 has a substantially circular cylindrical cap mounting portion 54 at one end side 53*a* and is formed into a substantially cup-shaped cylindrical shape widening from the one end side 53*a* toward the other end side 53*b*. The housing 53 has a predetermined thickness (for example, 1.5 to 5 mm), an outer surface 53*e* and an inner surface 53*f* are formed into curved surfaces, respectively. In other words, the housing 53 is formed to be the same as the housing 6 illustrated in FIG. 1 except for that the cap mounting portion 54 is provided.

The cap mounting portion 54 includes the pair of depressions 21 which are formed on an inner wall 54*b* thereof linearly from an opening 55 to an opening 56 on the side opposite from the opening 55 in the housing 53 so as to face each other and the pair of guide projecting portions 22 adjacent to the depressions 21 which are formed so as to face each other. The lighting apparatus 5 is attached to the inner wall 54*b* of the cap mounting portion 54 by press fitting both end portions of the lighting apparatus 5 in the width direction of the substrate 23 into the pair of depressions 21 and 21 and is disposed in the housing 53. The guide projecting portions 22 guide the substrate 23 of the lighting apparatus 5 along the longitudinal direction.

The cap mounting portion 54 is formed with the projecting ridge 24 in a spiral pattern on an outer surface 54*a* thereof. The cap 25 is then screwed into the projecting ridge 24. The cap 25 is fixed by being caulked to the outer surface 54*a* of the cap mounting portion 54.

As illustrated in FIG. 6, the thermal conducting fins 7 are provided on the inner surface 53*f* extending from the mounting surface 11 of the housing 53 to the vicinity of the opening 55. The electrical supply line 43 configured to electrically connect the light-emitting body 4 and the lighting apparatus 5 is disposed between the thermal conducting fins 7 and 7.

Subsequently, operations of the second exemplary embodiment will be described.

Heat generated in the light-emitting body 4 is transferred from the thermal radiation plate 3 to the mounting surface 11 of the housing 53 and the thermal conducting fins 7. The heat transferred to the thermal conducting fins 7 is conducted to the housing 53. The housing 53 is subjected to a temperature rise due to the heat transferred from the thermal radiation plate 3, and the temperature rise causes the heat to be radiated from the outer surface 53*e* of the housing 53 to the outside space. The heat radiation is performed from the entire area of the outer surface 53*e* of the housing 53.

Since the apparatus body 52 is formed of a synthetic resin having high thermal conductivity, the heat transferred from the thermal radiation plate 3 to the mounting surface 11 of the housing 53 and the thermal conducting fins 7 is conducted quickly and is radiated from the outer surface 53*e* of the housing 53 to the outside space. Accordingly, the temperature rise of the light-emitting body 4 is inhibited.

The heat generated in the lighting apparatus 5 is transferred from the substrate 23 of the lighting apparatus 5 to the cap mounting portion 54 of the housing 53 and is released into the space in the housing 53. The heat transferred to the cap mounting portions 54 is transferred from the cap mounting portions 54 to the cap 25, and is radiated from the bulb socket to which the cap 25 is screwed to the outside space. The heat released into the space in the housing 53 is transferred to the thermal conducting fins 7 and then conducted to the housing 53, is transferred from the inner surface 53*f* of the housing 53 to the housing 53, and is radiated from the outer surface 53*e* to the outside space. Accordingly, the temperature rise of the circuit component 42 of the lighting apparatus 5 is inhibited.

Then, the apparatus body 52 is formed of synthetic resin, the light weight is achieved even when the plurality of thermal conducting fins 7 are provided on the inner surface 53*f* of the housing 53.

According to the lamp apparatus 51 in the exemplary embodiment, the apparatus body 52 is formed of synthetic resin having a high thermal conductivity, and the thermal radiation plate 3 having the light-emitting body 4 mounted thereon is attached to the other end side 53*b* of the housing 53 in contact with the thermal conducting fins 7. Therefore, the light weight of the apparatus body 52 is achieved and the heat generated in the light-emitting body 4 can be conducted quickly from the thermal conducting fins 7 to the housing 53, and be radiated from the outer surface 53*e* of the housing 53 to the outside space, whereby the lamp apparatus 51 has advantages such that the high-power and high-output of the LED bear chips 35 may be achieved.

Subsequently, a lamp apparatus and a luminaire according to a third exemplary embodiment will be described.

Figure 7:
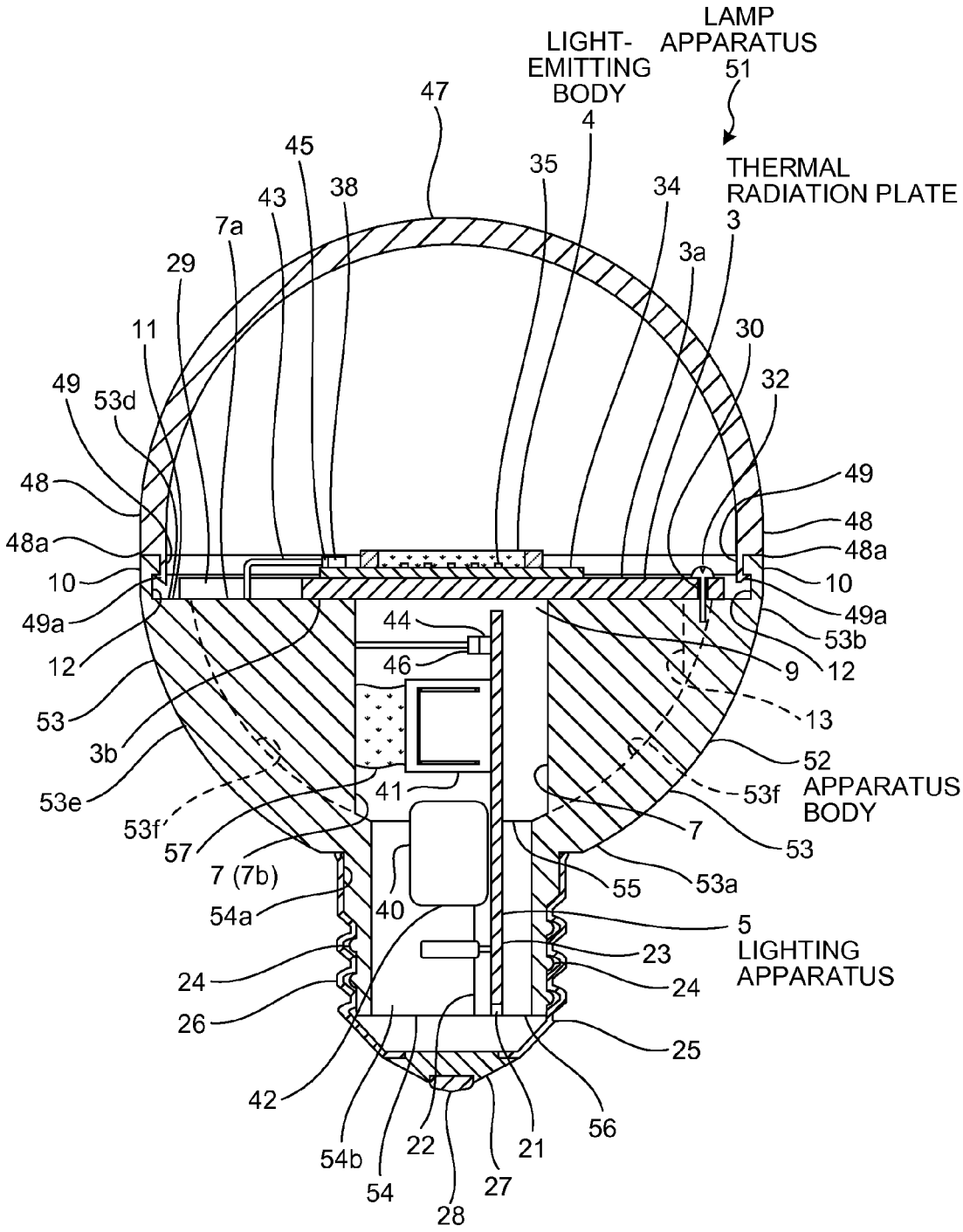
FIG. 7 is a schematic front cross-sectional view of a lamp apparatus according to a third exemplary embodiment.
Figure 8:
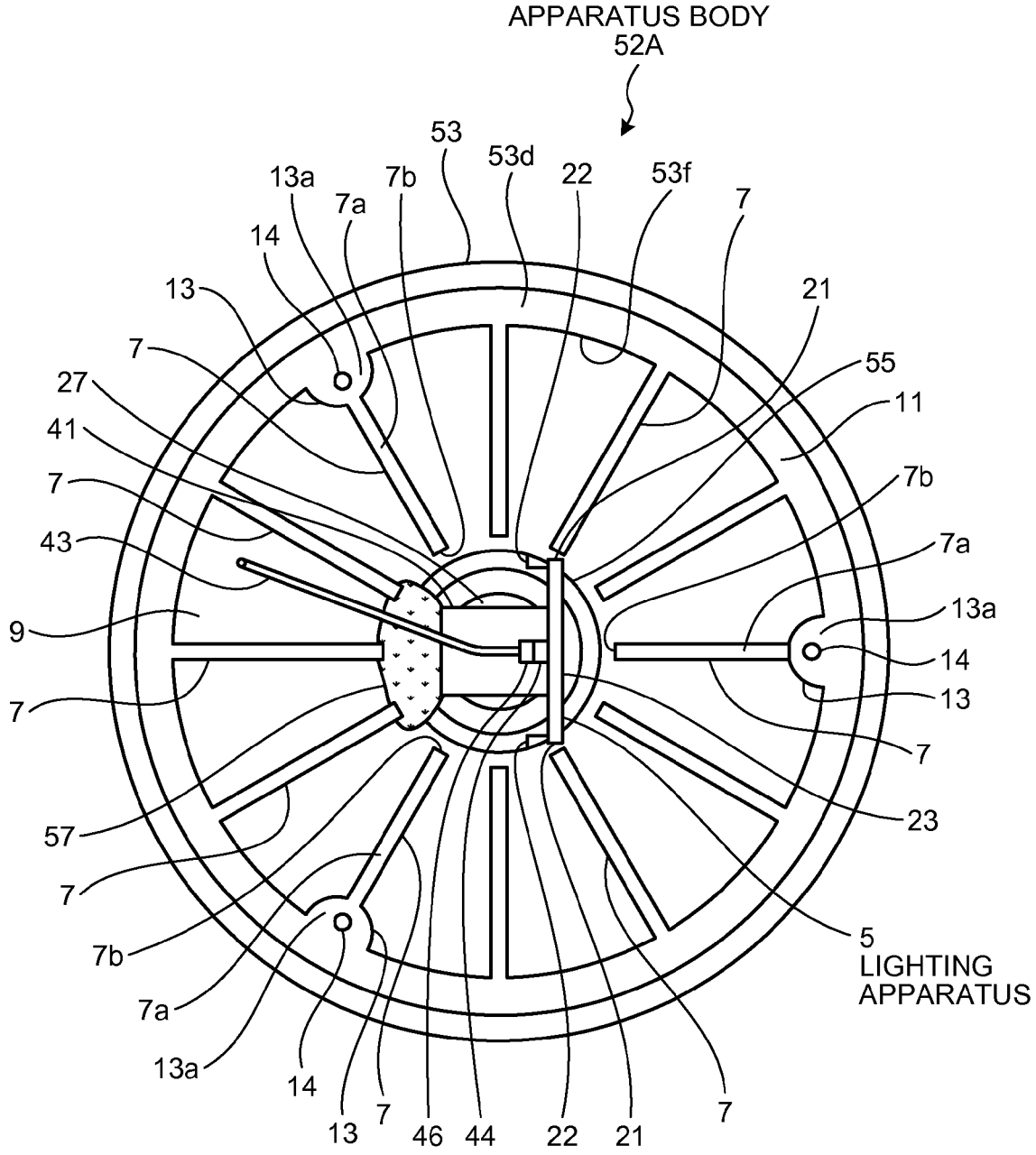
FIG. 8 is a schematic top view of an apparatus body.

A lamp apparatus 51A in this exemplary embodiment is configured as illustrated in FIG. 7 and FIG. 8. The same parts in FIG. 7 and FIG. 8 as those in FIG. 5 and FIG. 6 are designated by the same reference numerals and description will be omitted.

The lamp apparatus 51A is configured in such a manner that the circuit component 42 of the lighting apparatus 5 in the lamp apparatus 51 illustrated in FIG. 5 is connected to the thermal conducting fins 7 by a thermal conducting resin 57. Here, the thermal conducting resin 57 is provided on the transformer 41 generating a large quantity of heat. The thermal conducting resin 57 used here is a resin having electric insulating properties, high thermal resistant properties and high thermal conductivity such as, for example, a silicone resin.

As illustrated in FIG. 7, the thermal conducting resin 57 is interposed between the distal end side end surfaces (side end surfaces) 7*b* and the transformer 41 along the distal end side end surfaces (side end surfaces) 7*b* of the thermal conducting fins 7, and is provided so as to come into tight contact with the thermal conducting fins 7 and the transformer 41 respectively. As illustrated in FIG. 8, in the thermal conducting resin 57, the transformer 41 is provided so as to be connected with a plurality, in this example, three of the thermal conducting fins 7.

The thermal conducting resin 57 is provided between the transformer 41 and the thermal conducting fins 7 before the thermal radiation plate 3 is placed on the mounting surface 11 of the housing 53. For example, the thermal conducting resin 57 is build up from the transformer 41 to the thermal conducting fins 7 side in sequence with the substrate 23 of the lighting apparatus 5 faced downward of the direction in which the gravitational force works.

Heat generated in the transformer 41 is transferred quickly to the thermal conducting fins 7 by the thermal conducting resin 57 and is radiated from the outer surface 53*e* of the housing 53 to the outside space. Accordingly, the temperature rises of the space in the housing 53 and the transformer 41 are inhibited respectively. Consequently, the temperature rise of the lighting apparatus 5 can be inhibited.

In the lamp apparatus 1 of the first exemplary embodiment, the thermal conducting resin 57 may be provided between the thermal conducting fins 7 and the mounting body 15. The thermal conducting resin 57 may also be provided between the thermal conducting fins 7 and the circuit component 42 by notching a portion of the mounting body 15 to which the circuit component 42 of the lighting apparatus 5 faces.

In the first to third exemplary embodiments, the number or the thickness (wall thickness) or the shape of the thermal conducting fins 7 are not specifically limited as long as the heat from the thermal radiation plate 3 can be conducted quickly by coming into contact with the thermal radiation plate 3. In other words, the thermal conducting fins 7 do not have to be a plate shape, and may not be provided at regular intervals or radially on the inner surfaces 6*f* and 53*f* of the housings 6 and 53 and a configuration of a single thermal radiating fin is also applicable.

The housings 6 and 53 may be formed with the thermal radiating fins on the outer surfaces 6*e* and 53*e* thereof. The shape of the housings 6 and 53 is not limited to the substantially cup shape, and may be, for example, a circular cylindrical shape, a square cylindrical shape, a truncated conical shape, or a truncated pyramid shape, that is, only have to be formed into so-called cylindrical shapes.

The position where the circuit component 42 of the lighting apparatus 5 is disposed is not limited to the space surrounded by the distal end side end surfaces 7*b* as the distal ends of the thermal conducting fins 7, and the circuit component 42 of the lighting apparatus 5 may be provided partly between the thermal conducting fins 7 and 7.

Subsequently, a lamp apparatus and a luminaire according to a fourth exemplary embodiment will be described.

Figure 9:
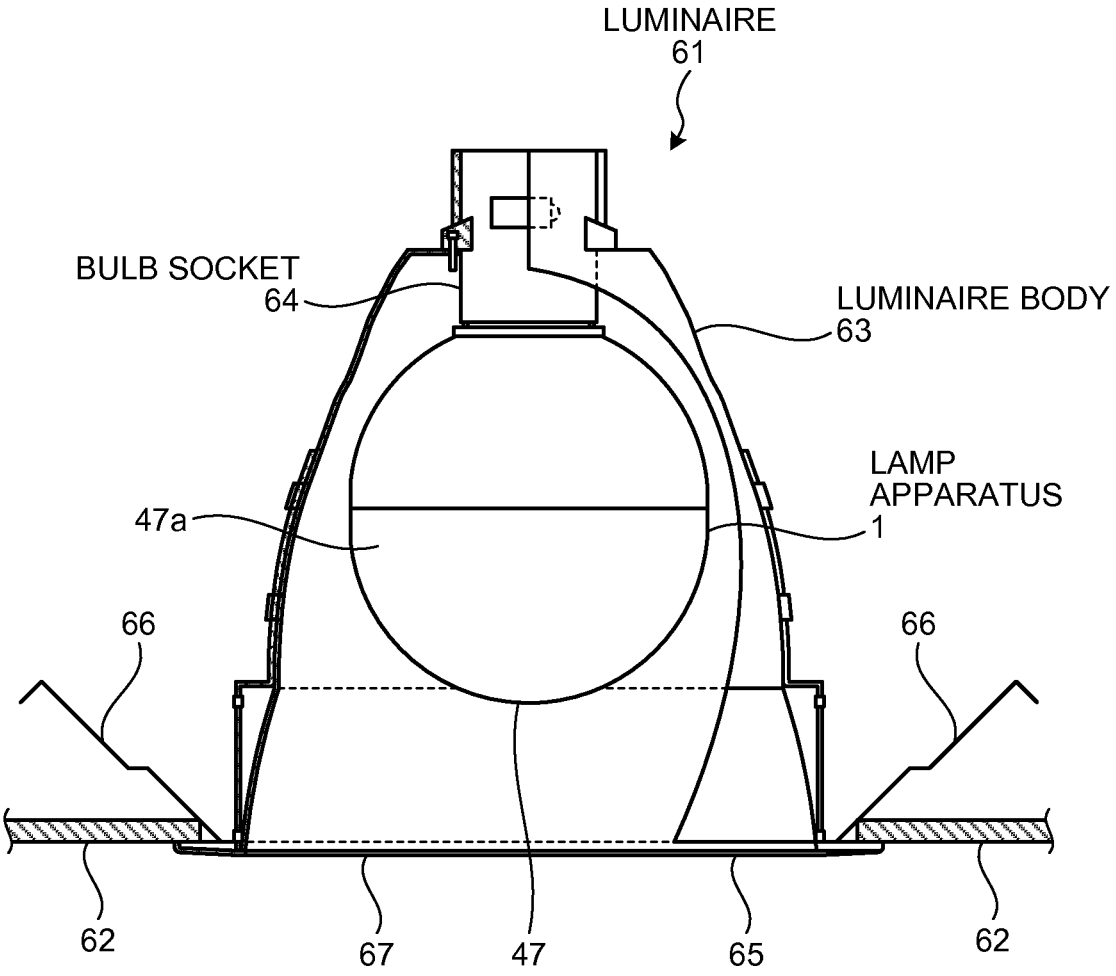
FIG. 9 is a schematic front view, partly broken, of a luminaire according to a fourth exemplary embodiment.
Figure 10:
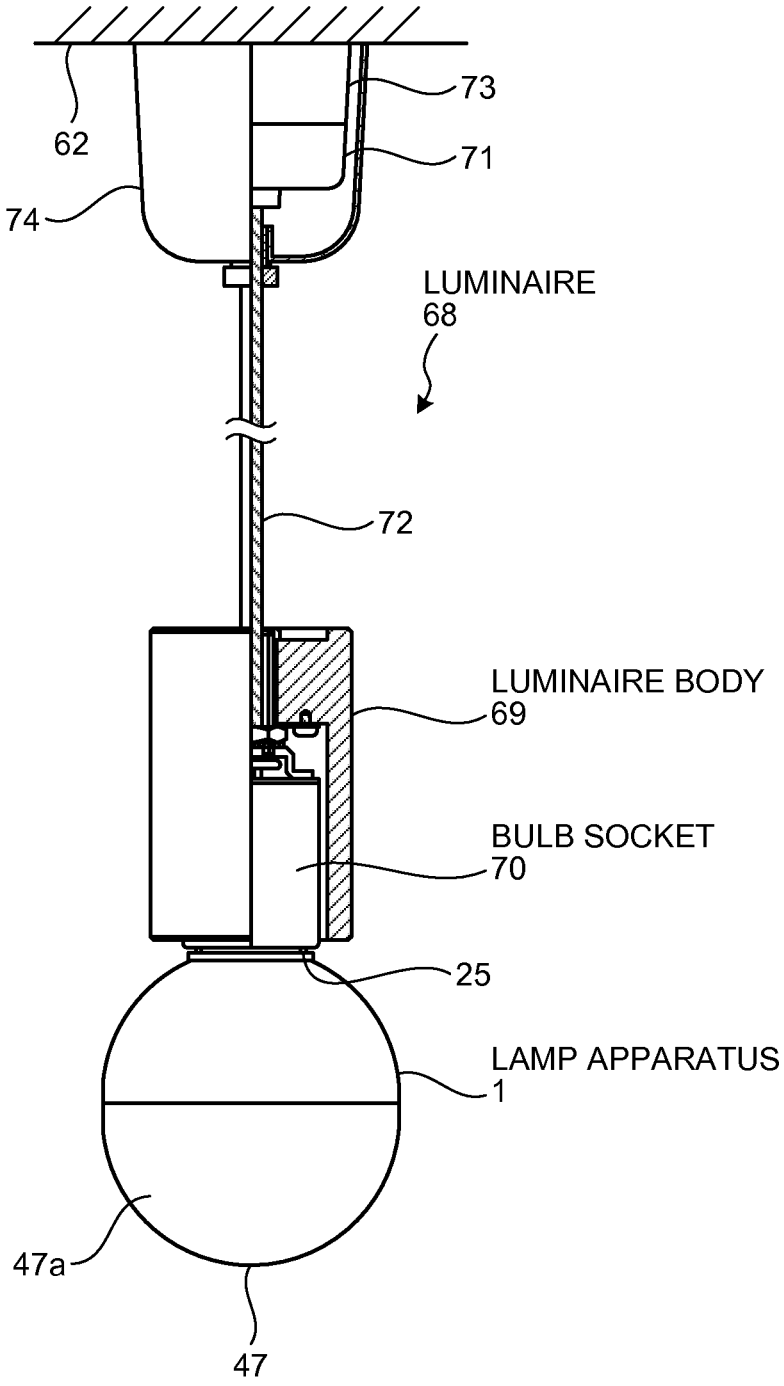
FIG. 10 is a schematic front view, partly broken, of another luminaire.

FIG. 9 is a schematic front view, partly broken, of the luminaire according to the fourth exemplary embodiment, FIG. 10 is a schematic front view, partly broken, of another luminaire of the same exemplary embodiment. In respective drawings, the same parts as those in FIG. 1 are designated by the same reference numerals and overlapped descriptions are omitted.

A luminaire 61 illustrated in FIG. 9 is a downlight using the lamp apparatus 1 illustrated in FIG. 1, and is embedded in a ceiling 62. A bulb socket 64 as a socket is disposed on a luminaire body 63 having an outer shape of a substantially circular bottomed cylindrical shape. The luminaire body 63 is held by the ceiling 62 by a cover member 65 which is provided integrally with the luminaire body 63, and leaf springs 66 and 66 and is fixed to the ceiling 62. Then, the lamp apparatus 1 is mounted on the bulb socket 64.

When the bulb socket 64 is energized, the lighting apparatus 5 (not illustrated) of the lamp apparatus 1 is operated, and a predetermined constant current is supplied to the respective LED bear chips 35 (not illustrated) of the light-emitting body 4 (not illustrated). Accordingly, the plurality of LED bear chips 35 are lit and white light is radiated from the globe 47. Then, the white light radiated from an outer surface 47*a* of the globe 47 is output from an opening 67 of the cover member 65 to a floor side.

A luminaire 68 illustrated in FIG. 10 is a pendant luminaire to be suspended from the ceiling 62, and a bulb socket 70 as a socket used for attaching the cap 25 of the lamp apparatus 1 is disposed in an luminaire body 69 having an outline of a bottomed circular cylindrical shape. The luminaire body 69 includes a power supply cord 72 having a ceiling plug cap 71 connected thereto at a distal end thereof.

The ceiling plug cap 71 is attached to a ceiling plug body 73 disposed on the ceiling 62. Accordingly, an external power is supplied to the bulb socket 70 via the power supply cord 72 or the like. The ceiling plug cap 71 and the ceiling plug body 73 are covered with a ceiling cover 74. The lamp apparatus 1 is mounted on the bulb socket 70.

The lamp apparatus 1 is lit or extinguished by operation of a wall switch, not illustrated, between ON and OFF. Then, the white light radiated from the outer surface 47*a* of the globe 47 illuminates the floor side.

With the provision of the high power or high output lamp apparatus 1 by the LED bear chips 35 of the light-emitting body 4, the luminaires 61 and 68 of the exemplary embodiment are advantageous in that the floor side can be illuminated brightly by the white light radiated from the globe 47.

The luminaire of the exemplary embodiment is not limited to the embedded type or the pendant type, and may be a ceiling luminaire.

Although several embodiments of the present invention have been described, these embodiments are illustrated as examples and are not intended to limit the scope of the invention. These embodiments may be implemented in other various modes, and various omissions, replacements, and modifications may be made without departing the scope of the invention. These embodiments and the modifications are included in the scope and gist of the invention, and are included in the invention claimed in claims and in the equivalent range.

What is claimed is:

1. A lamp apparatus, comprising:

an apparatus body including a housing having a cap at one end side and an annular wall formed on an end surface of another end side, inside the annular wall an annular flat mounting surface is formed, and a plurality of thermal conducting fins formed into a plate shape integral with the housing in a direction of an inner circumference of the housing on an inner surface of the housing, extending from the one end side toward the other end side of the housing in a state in which at least a part of upper side end surfaces of the plurality of thermal conducting fins located in the other end side are flush with the mounting surface, the plurality of thermal conducting fins projecting radially inwardly towards a center of the housing with a clearance between distal ends of the thermal conducting fins, and distal end side end surfaces of the distal ends extending from the one end side to the other end side;

a thermal radiation plate attached to the other end side of the housing in a state in which one surface side is in contact with the thermal conducting fins and the mounting surface;

a light-emitting body attached to another surface side of the thermal radiation plate so as to overlap with at least a part of the plurality of thermal conducting fins; and a mounting body disposed in a space which is surrounded by the distal ends of the thermal conducting fins in a state in which the mounting body is mechanically and thermally separated from the thermal conducting fins and having electric insulating properties and accommodating a lighting circuit which lights the light-emitting body.

2. The apparatus according to claim 1, wherein the thermal conducting fins are provided substantially at regular intervals in a direction of an inner circumference of the housing.

3. The apparatus according to claim 1, wherein the lighting circuit includes a substrate and a circuit component mounted on the substrate, and the circuit component is thermally connected to the thermal conducting fins by a thermal conducting resin.

4. A luminaire comprising:

the lamp apparatus according to claim 1; and a luminaire body having a socket to which the lamp apparatus is connected.

* * * * *